United States Patent [19]

Baumann et al.

[11] 4,164,178

[45] Aug. 14, 1979

[54] CONTAINER, CLOSABLE BY A LID, FOR RECEIVING AND COMPRESSING WASTE

[75] Inventors: Manfred Baumann; Walter Besserer, both of Diepoldsau, Switzerland

[73] Assignee: Apura GmbH, Mainz-Kostheim, Fed. Rep. of Germany

[21] Appl. No.: 897,452

[22] Filed: Apr. 18, 1978

[30] Foreign Application Priority Data

Apr. 19, 1977 [CH] Switzerland ..... 004858/77

[51] Int. Cl.[2] ..... B30B 1/04

[52] U.S. Cl. ..... 100/99; 100/233; 100/245; 100/265; 248/101

[58] Field of Search ..... 100/99, 233, 265, 226, 100/245, 229 A, 252, 219; 53/124 B, 529; 248/99, 100, 101; 232/43.2, 43.5

[56] References Cited

U.S. PATENT DOCUMENTS

| | | | |
|---|---|---|---|
| 1,832,561 | 11/1931 | Kleinberg | 248/101 |
| 1,990,894 | 2/1935 | Brubaker | 100/265 X |
| 2,423,209 | 7/1947 | Storey | 100/252 X |
| 2,712,233 | 7/1955 | Raynor | 100/99 |
| 3,241,750 | 3/1966 | Brighton | 248/101 |
| 3,357,346 | 12/1967 | Crafoord | 100/265 X |
| 3,696,737 | 10/1972 | Wikner | 100/233 |

FOREIGN PATENT DOCUMENTS

| | | | |
|---|---|---|---|
| 764207 | 8/1967 | Canada | 100/226 |
| 1049489 | 11/1966 | United Kingdom | 232/43.2 |

*Primary Examiner*—Billy J. Wilhite

*Attorney, Agent, or Firm*—Sughrue, Rothwell, Mion, Zinn and Macpeak

[57] ABSTRACT

The invention provides a container for waste materia, particularly but not exclusively for paper waste, comprising, a casing forming a container for waste material having structure defining an opening for entry to the container, a lid movably mounted on the casing adjacent the opening for movement between an open position allowing waste to be put into the container opening, and a closed position closing the opening of the container, the lid being formed so that in its closed position it extends into the container beyond the extremity of said container structure to occupy a volume within the container at least equal to that of an item of waste for which the container is intended, and means for releasably retaining the lid in its closed position, whereby each time waste is inserted through the opening and the lid closed, the waste in the container is progressively compressed and a space is created for the reception of further waste when the lid is next opened.

25 Claims, 22 Drawing Figures

50
53
54a
55a
70
81
73a
55b
54b
73b
74
Vc
Vb
72
51
52

CONTAINER, CLOSABLE BY A LID, FOR RECEIVING AND COMPRESSING WASTE

BACKGROUND OF THE INVENTION

The invention relates to a container, which can be closed by a lid, for receiving and compressing waste material, more particularly waste paper. The container can also be used for other kitchen waste and other easily deformable waste, such as thin sheet-metal packaging items, cardboard or plastics.

Hitherto waste has been deposited in a solid container, a wire basket, or in a stretch plastics bag. Some of these containers are open, while some of them are provided with a lid or flap. None of the containers can take more than relatively small amounts of waste unless the waste is compressed. This has the disadvantage that the waste containers must be emptied at short intervals, and public waster containers become overfilled, due to inadequate servicing, so that waste lies beside the container. This also applies more particularly to waste containers provided for the paper tissues used in many public lavatories and washrooms.

Apparatus for compressing the waste in a container are also known (e.g. German Offenlegungsschrift No. 19 23 396 or U.S. Pat. No. 3,696,737), in which a pressure plate in the container is moved by a mechanism, so as to compress the contents of the container. However, these prior art devices cannot satisfactorily solve the problems, particularly the problem of the overflowing of public waste containers, since on the one hand an adequate amount of waste cannot be accommodated in the container, and on the other hand special procedures which must be performed by trained operators, are required to compress the contents of the container.

It is an object of the invention to avoid the deficiencies of the prior art containers and provides a simply constructed container of the kind specified which calls for little maintenance and which can readily be operated, and in which several times the amount of waste can be reliably accommodated than was the case with the prior art.

SUMMARY OF THE INVENTION

Accordingly the present invention provides a container for waste material, particularly but not exclusively for paper waste, comprising a casing forming a container for waste material having structure defining an opening for entry to the container, a lid movably mounted on the casing adjacent the opening for movement between an open position allowing waste to be put into the container opening, and a closed position closing the opening of the container, the lid being formed so that in its closed position it extends into the container beyond the extremity of said container structure to occupy a volume within the container at least equal to that of an item of waste for which the container is intended, and means for releasably retaining the lid in its closed position.

As soon as loosely stratified waste fills the container up to the bottom of the lid in its closed position, the compressing operation starts with the lid constructed according to the invention. Each further piece of waste is introduced into the space occupied by the lid when the container is closed and is individually compressed by the closing lid and thus forced into the container. For this purpose only a relatively low pressure is required. The locking of the lid in its closed position means that the compressed waste must remain in the fixed volume of the container. Consequently, after a short time the inner tension of the waste is dispersed, so that it no longer springs back when the lid is opened again. As a result when the lid is opened a free space, corresponding to the shape of the lid, is produced in the upper part of the waste container, and it is possible to throw into such space fresh, uncompressed pieces of waste which are again compressed with the following closure movement of the lid. The container according to the invention can in this manner accommodate several times, for instance, five to eight times the container volume of free, uncompressed, waste.

In an advantageous embodiment of the invention, the lid is pivotally mounted around a horizontal axis, and its movement to its closed position is controlled by a device which causes an increasing contact pressure between the lid and the waste when the lid moves from the open to the closed position. This allows a further increase of the amount of waste which can be accommodated in a container.

A preferred arrangement for the device for producing an increasing contact pressure is a lever mechanism which at the end of its travel locks the closed lid and comprises, for instance, a lever-controlled cam disc, or a cam-disc-controlled lever, a toggle mechanism, or a spring operating via a lever arm which increases in size during the closure movement of the lid. These devices can be operated manually or by means of a pedal.

In another advantageous embodiment of the invention, the lid is manually actuated and locked in its closed position by a releasable locking device, and the increased contact pressure may be produced by the muscular force of the container user.

Also advantageously, use is made, for the compression of the pieces of waste and forcing them into the container, of the kinetic energy of the freely falling or pivoting lid which, for instance, is manually operated, can be retained in its opened position, and is locked by a releasable locking device in its closed position. The lid is preferably automatically released from its retained open position shortly after it has been placed therein.

Also advantageously for the practical use of the container, the lid is actuated by a pedal which is maintained rigid against distortion, for instance, by means of a rack and pinion gear arrangement. Reliable operation of the lid is always ensured independently of where a user places his foot on the pedal. Moreover, the life of the pedal and therefore of the lid-actuating device is considerably lengthened.

In another advantageous embodiment of the invention, a maintenance signalling device, having a spring loaded pressure sensor is provided in the lid and connected to an indicating device visible outside the container. With a given pressure of the waste compressed in the container servicing personnel may thus be informed in a very simple manner by the indicator system that the container must be emptied, either immediately or after a given further amount of waste has been received. Without a maintenance signal system of this kind, the basic advantage of the invention, namely to accommodate large amounts of wastes in a container, might possibly not be used to the optimum, since servicing personnel would be unable to readily detect when the container capacity is nearly consumed, so that they might empty the container prematurely.

Advantageously to assist maintenance of the container, a lid frame, carrying the lid and having substantially the same height as the lid, is releasably connected to the container casing, for instance by means of a releasable pawl mechanism, and is arranged to be pivoted around a horizontal axis so that the lid frame may be swung over by servicing personnel to make more easy the emptying of the container, and protecting the lid hinge from strain and damage.

BRIEF DESCRIPTION OF THE DRAWINGS

Further advantages, features and possible applications of the invention can be gathered from the following description of embodiments thereof with reference to the drawings wherein.

DESCRIPTION OF PREFERRED EMBODIMENTS

Figure 1:
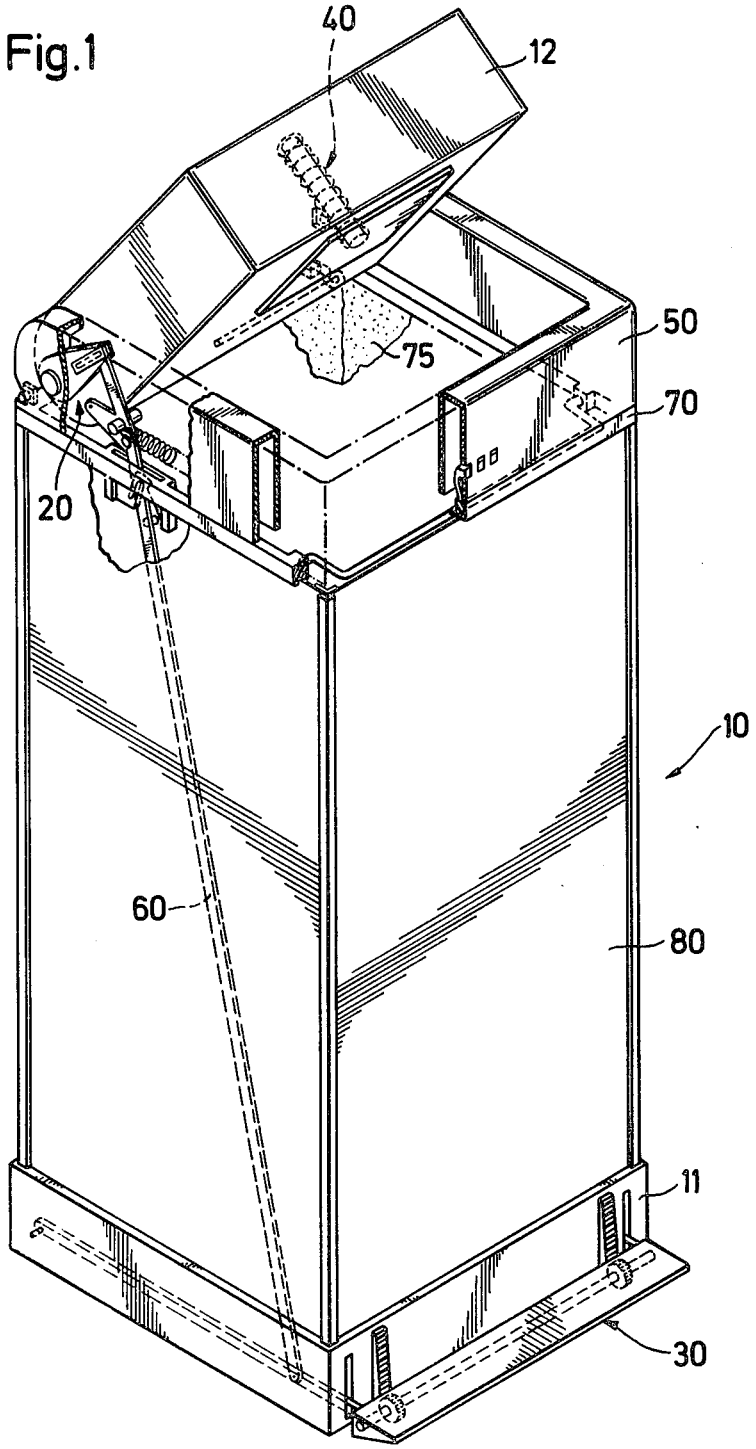
FIG. 1 is a perspective, partially broken-away view of a practical embodiment of the container according to the invention.

FIG. 1 illustrates a practical embodiment of a container 10. The container comprises, for instance, a base 11, a container casing 80, a frame capping strip 70, a removable bag 75, a lid frame 50 and a pivotally mounted lid 12. These parts of the container 10 are preferably interconnected for ready release. In the case of the container 10 illustrated in FIG. 1, the system for actuating and locking the lid 12 mainly comprises a pedal 30, a pull rod 60 connected to the pedal 30 and guided on the inside of the container, and a lever mechanism indicated generally at 20 connected to the pull rod 60. A maintenance signal system 40 is also provided in the lid 12.

Figure 2A:
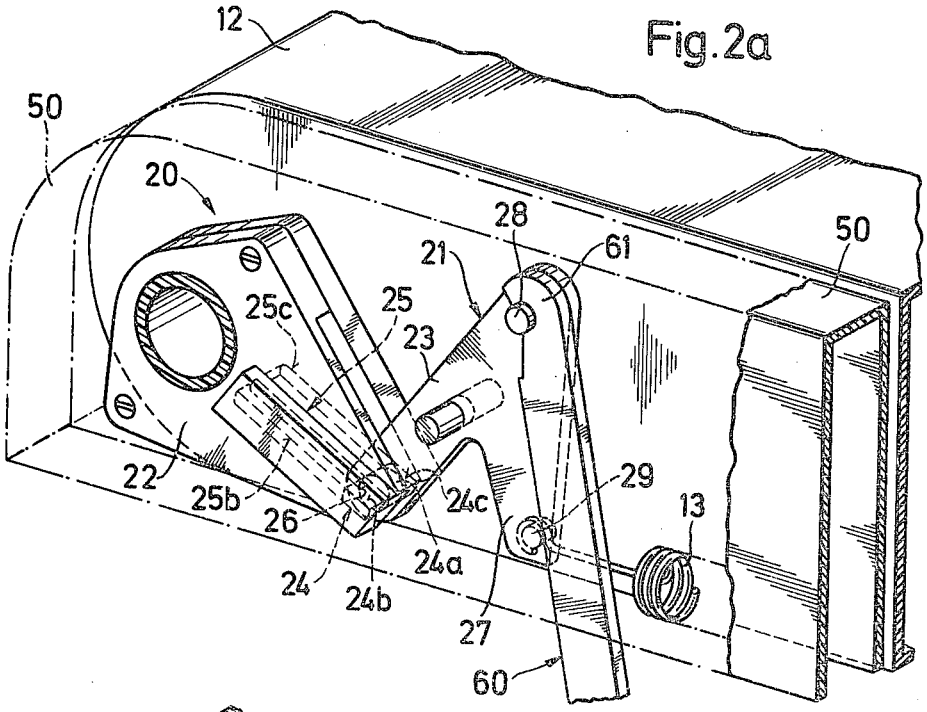
FIGS. 2*a* and 2*b* show in perspective the lever mechanism for actuating and locking the lid of the container illustrated in FIG. 1 in the closed and opened conditions.
Figure 2B:
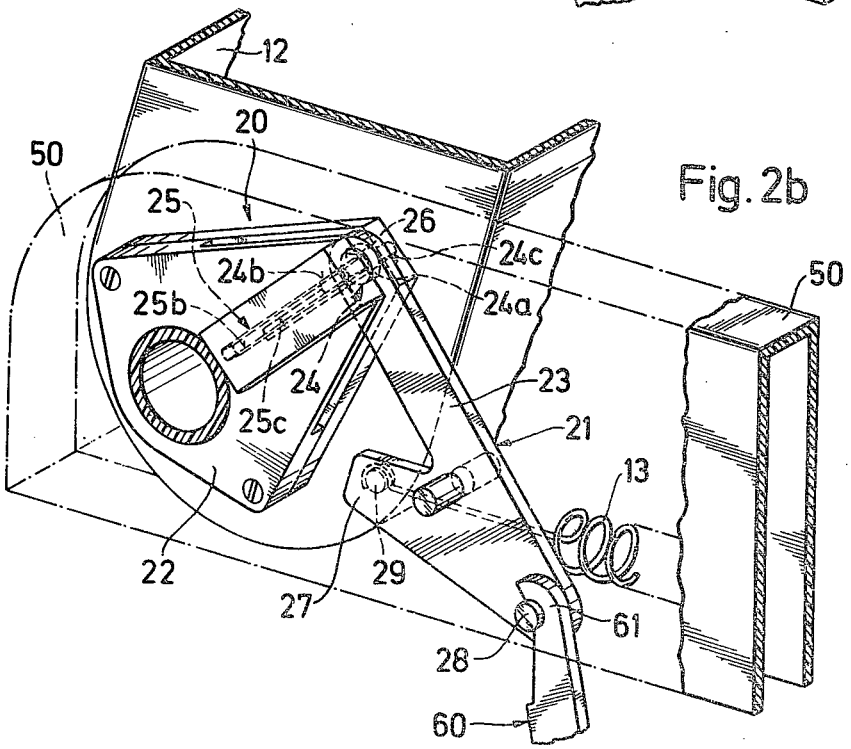

The lever mechanism illustrated in detail in FIGS. 2*a* and 2*b* consists of a first two-armed lever 21, pivotably mounted on the lid frame 50, and a second lever 22, attached for rotation with the lid 12. At the end of its arm 23 the two armed lever 21 has a drive dog 24 guided in a slot 25 in the lever 22. A functionally reliable construction of the drive dog 24 has a cylindrical central portion 24*a*, which is pivotably received in an eyelet 26 at the end of the arm 23, and flattened end portions 24*b*, 24*c* which are guided in cam-shaped recesses 25*b*, 25*c*, open on one side only, in the lever 22. The pull rod 60 is releasably connected to the end of the other arm 27 of the lever 21, by, for instance, a hook-shaped end portion 61 of the pull rod engaging with a pin 28 attached to the arm 27. The substantially triangular arm 27 has on the side of the arm 27 opposite the pin 28 a further pin 29 which is disposed offset in relation to the pin 28 substantially at a corner point of the triangle, the pin 29 being connected via a prestressed tension spring 13 to the lid frame 50.

The system for actuating and locking the lid 12 illustrated in FIGS. 1 to 3 operates as follows: depression of the pedal 30, whose construction will be described in greater detail hereinafter, moves the lever mechanism 20 and the lid 12 out of the closed position (FIG. 2*a*) into the open position (FIG. 2*b*). The two-armed lever 21 is pivoted by the pull rod 60 through approximately 90° clockwise. During this movement of the two-armed lever 21 the lever 22 is also rotated anticlockwise in controlled fashion via the drive dog 24 and the recesses 25*b*, 25*c* through approximately 90°, so that the lid 12 is opened for the introduction of waste. During this opening movement the loaded tension spring 13 is further stressed. After waste has been introduced into the container 10, or more precisely into the bag 75, the pedal 30 is again released by the user. The two-armed lever 21 is then pivoted back anticlockwise through approximately 90° into its starting position (FIG. 2*a*) by the tension spring 13. At the same time the lever 22 is pivoted back clockwise through approximately 90° to its starting position, so that the lid 12 closes the container 10. The association of the levers 21 and 22 ensures that the contact pressure of the lid 12 on the waste, which has risen as for as the bottom face 41 of the closed lid 12, heavily increases when the container 10 is closed—i.e. during the transition from the position illustrated in FIG. 2*b* to the position illustrated in FIG. 2*a*. An alternate curved construction of the slot 25 as against the straight construction shown in FIGS. 2*a* and 2*b* is advantageous in that during the lid closure movement the contact pressure increases more quickly to higher values, so that the individual pieces of waste introduced are more reliably compressed and more reliably forced into the given container volume. In the position illustrated in FIG. 2*a* the lever mechanism 20 locks the lid 12 in the closed position.

Figure 3:
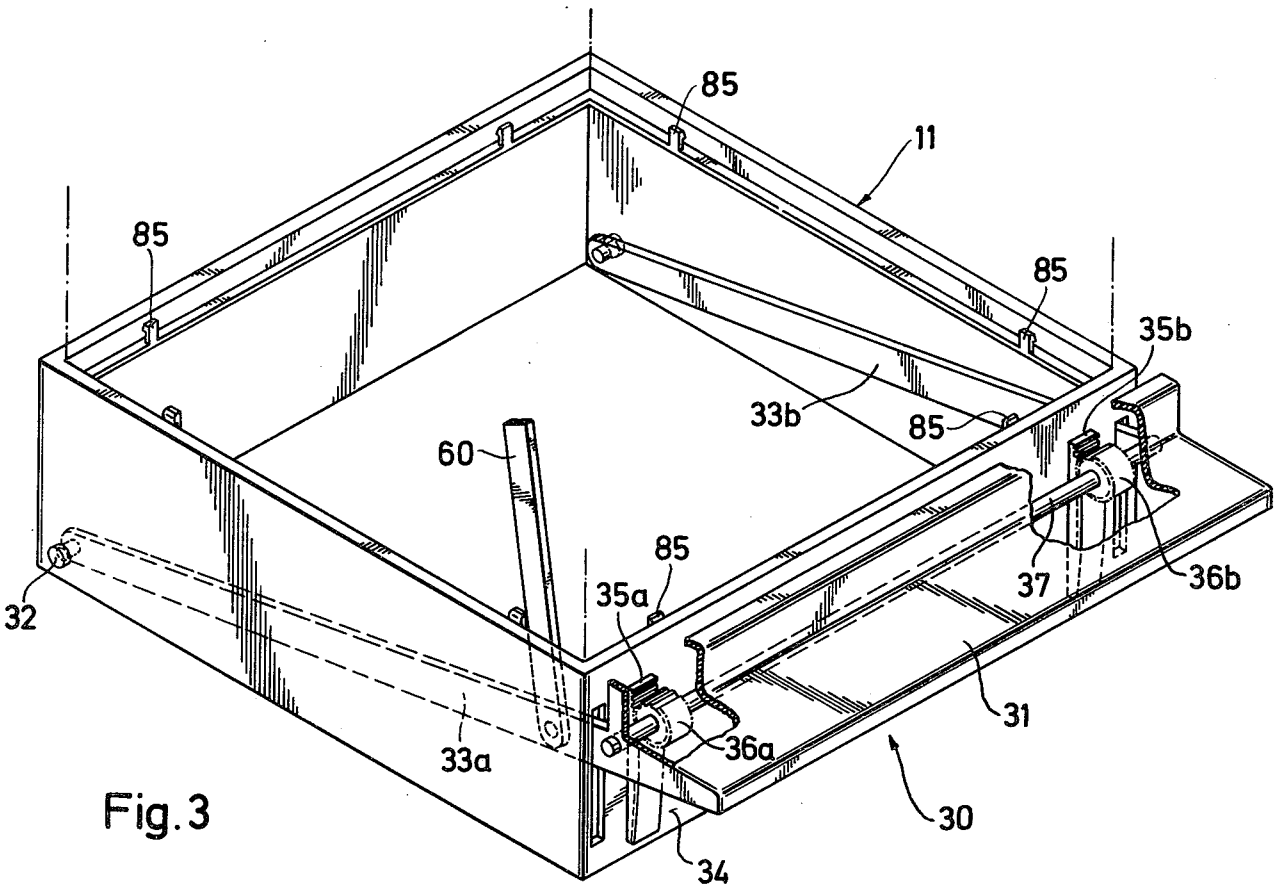
FIG. 3 shows in perspective the base of the container illustrated in FIG. 1, with the pedal for actuating the lid.

FIG. 3 shows a particularly advantageous arrangement of the pedal 30. Since conveniently, as illustrated, only one pull rod 60 is provided to actuate the lever mechanism 20 (a pull rod on both sides in the container would result in the lever mechanism jamming), there is a risk of the pedal 30 being distorted, due to the one-sided action of the pull rod 60, if force is exerted asymmetrically on the pedal. This risk is obviated by the method of guiding the pedal 30 illustrated in FIG. 3. The pedal 30 comprises a treadle 31 carried on two pedal arms 33*a*, 33*b* mounted to pivot around an axis 32 inside the base 11 and emerging at the front face. The pull rod 60 is connected to the pedal arm 33*a*. Racks 35*a*, 35*b* are attached to respective sides of the front wall 44 of the base 11. The racks 35*a*, 35*b* each mesh with respective gearwheels 36*a*, 36*b* which are attached to a shaft 37 borne on the pedal arms 33*a*, 33*b*. This rack and pinion gear between the pedal 30 and the base 11 ensures that the pedal 30 is guided in its movement to remain horizontal, independently of the position at which the user places his foot on the treadle 31. In the embodiment illustrated, therefore, the pedal arms 33*a*, 33*b* are not distorted in use, nor is the treadle 31 moved oblique, thus ensuring a longer life of the pedal 30, which thus always operates reliably.

Figure 4A:
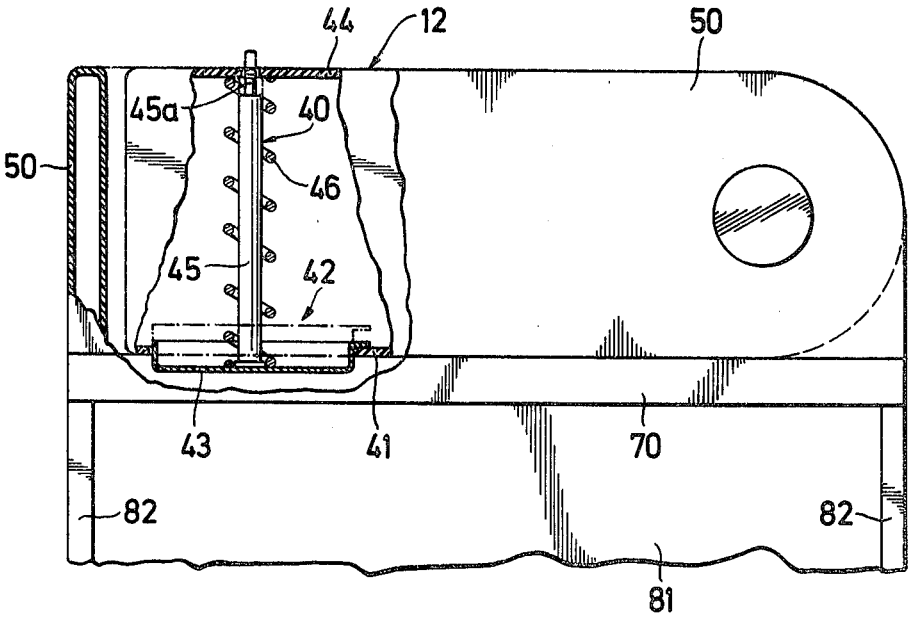
FIG. 4*a* is a partially broken away side elevation of the upper part of the container illustrated in FIG. 1, with a maintenance signal system.

FIG. 4*a* shows in greater detail an embodiment 40 of the maintenance signalling system. It comprises a pressure sensor 42 having a plate 43 which is let into a recess in the underside 41 of the lid and engages a land above the underside 41, and a rod 45 which is attached to the plate 43 and passes through the top wall 44 of the lid 12 with shouldered portion 45*a*. A compression spring 46 is disposed around the rod 45 between the plate 43 and the top wall 44 of the lid 12. In the normal condition of the container, in which no servicing is required and further pieces of waste can be introduced, the pressure sensor 42 is in the position shown in continuous lines, in which the portion 45*a* of the rod 45 lies, for instance, flush the top face of the wall 44 of the lid 12. At a pressure of the waste compressed in the container which is determined by the preloading of the compression spring 46, the plate 43 and therefore the rod portion 45*a* are shifted upwards in the position shown in chain dot lines in FIG. 4*a*. Since the shouldered rod portion 45*a* projects beyond the top side 44 of the lid 12, servicing personnel can see that the container is full enough and should therefore be emptied.

Figure 4B:
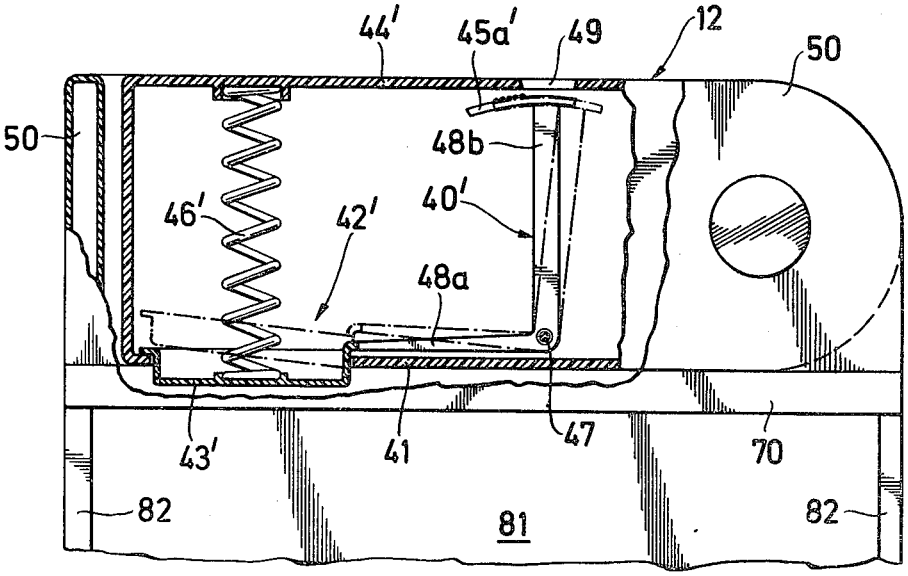
FIG. 4*b* is a view corresponding to FIG. 4*a*, showing a different maintenance signal system.

FIG. 4*b* illustrates a variant embodiment 40' of the maintenance signalling system with a two-armed pressure sensor 42' mounted to pivot around an axis 47. The arm 48*a* of the pressure sensor 42' has a plate 43, constructed similarly to the plate 43, which is connected via a compression spring 46' to the top wall 44' of the lid 12. The other arm 48*b* of the pressure sensor 42' has a signal disc 45*a'* having, for instance, green and red areas, which can be pivoted in front of a window 49 in the top wall 44' of the lid 12. If the pressure of the waste exceeds the pre-loading of the compression spring 46', the pressure sensor 42' is moved into the position shown in chain dot lines in FIG. 4*b*, in which the red zone, for instance, of the signal disc 45' can be seen through the window 49.

Figures 5A, 5B, 5C:
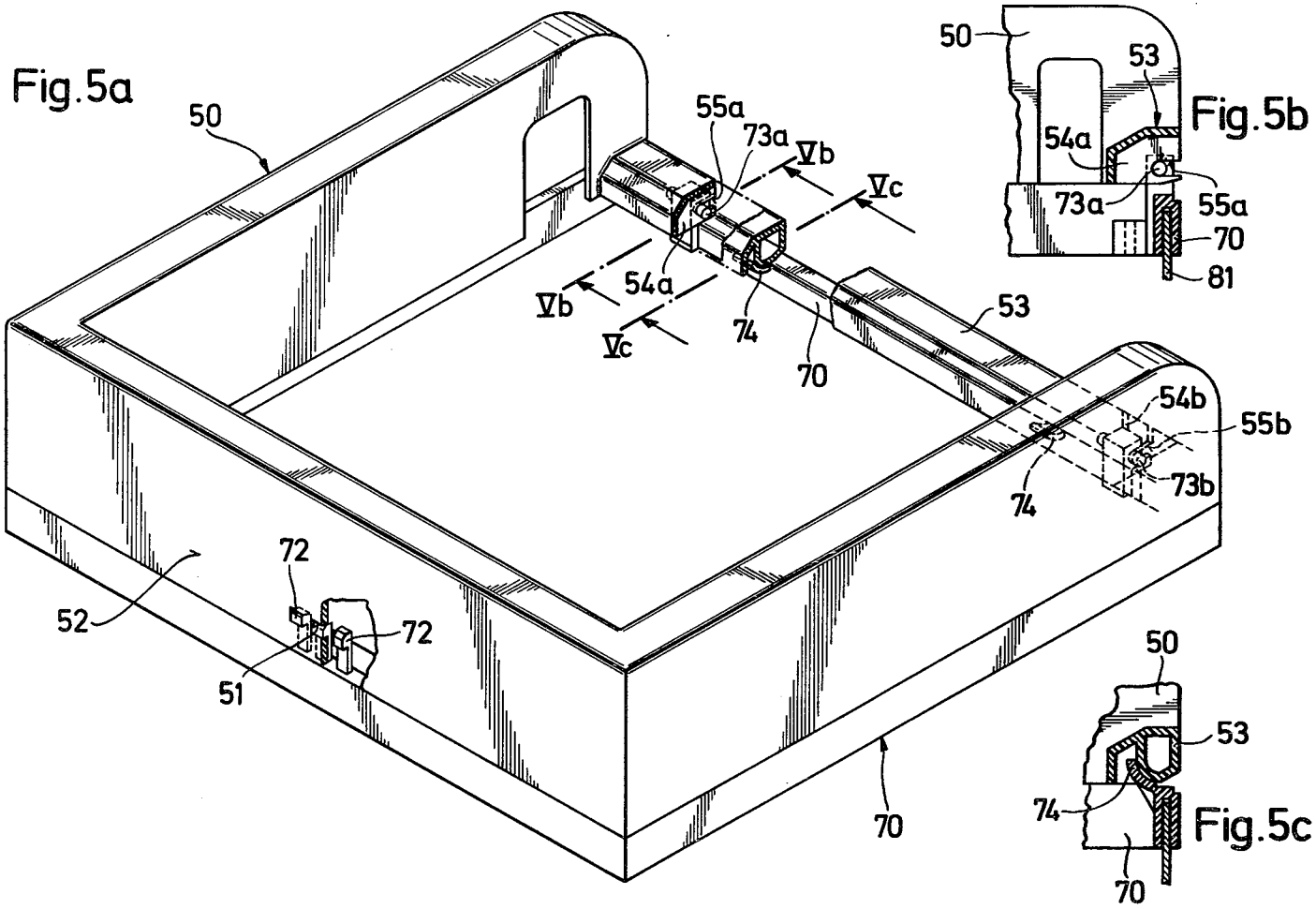
FIG. 5*a* is a perspective, partially broken away view of the lid frame and its attachment to the casing of the container illustrated in FIG. 1.
FIG. 5*b* is a section taken along the line Vb—Vb in FIG. 5*a*.
FIG. 5*c* is a section taken along the line Vc—Vc in FIG. 5*a*.
Figure 7A:
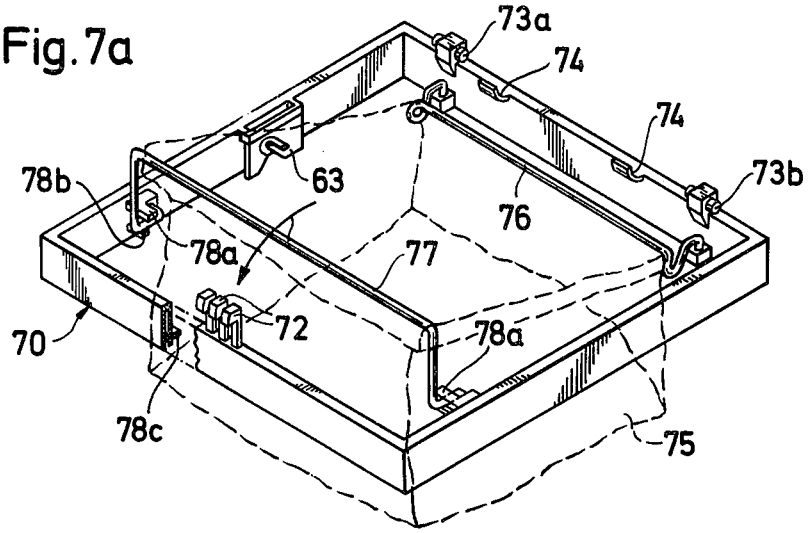
FIG. 7*a* is a perspective, partially broken away view of the frame strip of the container illustrated in FIG. 1, with the bowed members at the start of a bag suspension operation, FIG. 7*b*, which corresponds to FIG. 7*a*, shows the frame strip on completion of bag suspension.
Figure 7B:
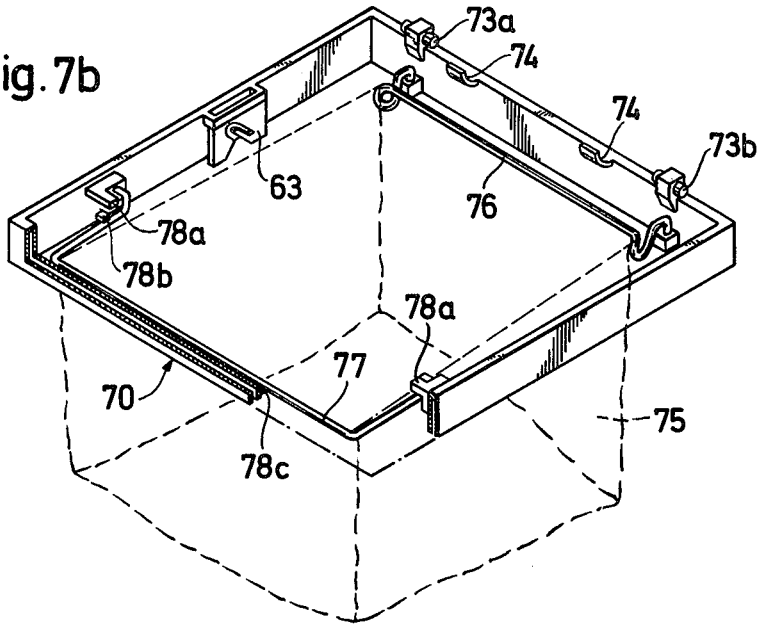

FIG. 5*a* shows a simple and reliable attachment of the lid frame 50 to the frame capping strip 70, which can be very simply released to empty the container. Disposed on the front side of the capping strip 70 are three resilient pawls 72 (see also FIG. 7*a*) which latch into matching apertures 51 in the front side 52 of the lid frame 50. This so-called "Apura" lock can be opened by means of a three-pronged socket wrench, the three resilient pawls 72 being forced out of the corresponding apertures 51. For instance, two transverse webs or double transverse webs 54*a*, 54*b* having rearwardly open-hinge sockets 55*a*, 55*b* are provided in an angled cross-section member 53 connecting the lateral parts of the lid frame 50 at the rear side thereof. Each of the hinge sockets engages with hinge pins 73*a*, 73*b* which are disposed on the capping strip 70 (shown more particularly in FIG. 5*b*). After the "Apura" lock has been opened, the lid frame 50 can therefore be pivoted upwards around a horizontal axis by means of the hinge 55*a*, 55*b*, 73*a*, 73*b*, so that the servicing personnel may have access to the inside of the container 10, more particularly to the waste bag 75 to be removed.

To prevent the opened lid frame 50 from moving forwards, lugs 74 extending forwardly and upwardly are disposed on the rear side of the capping strip 70 and partially engage behind the member 53 of the lid frame 50, as can be gathered more particularly from FIG. 5*c*. If during maintenance the lid frame 50 is accidentally pivoted too far, the hinge sockets 55*a*, 55*b* automatically become released from the hinge pins 73*a*, 73*b* and therefore readily release the lid frame 50 without any attaching elements being destroyed.

Figure 6:
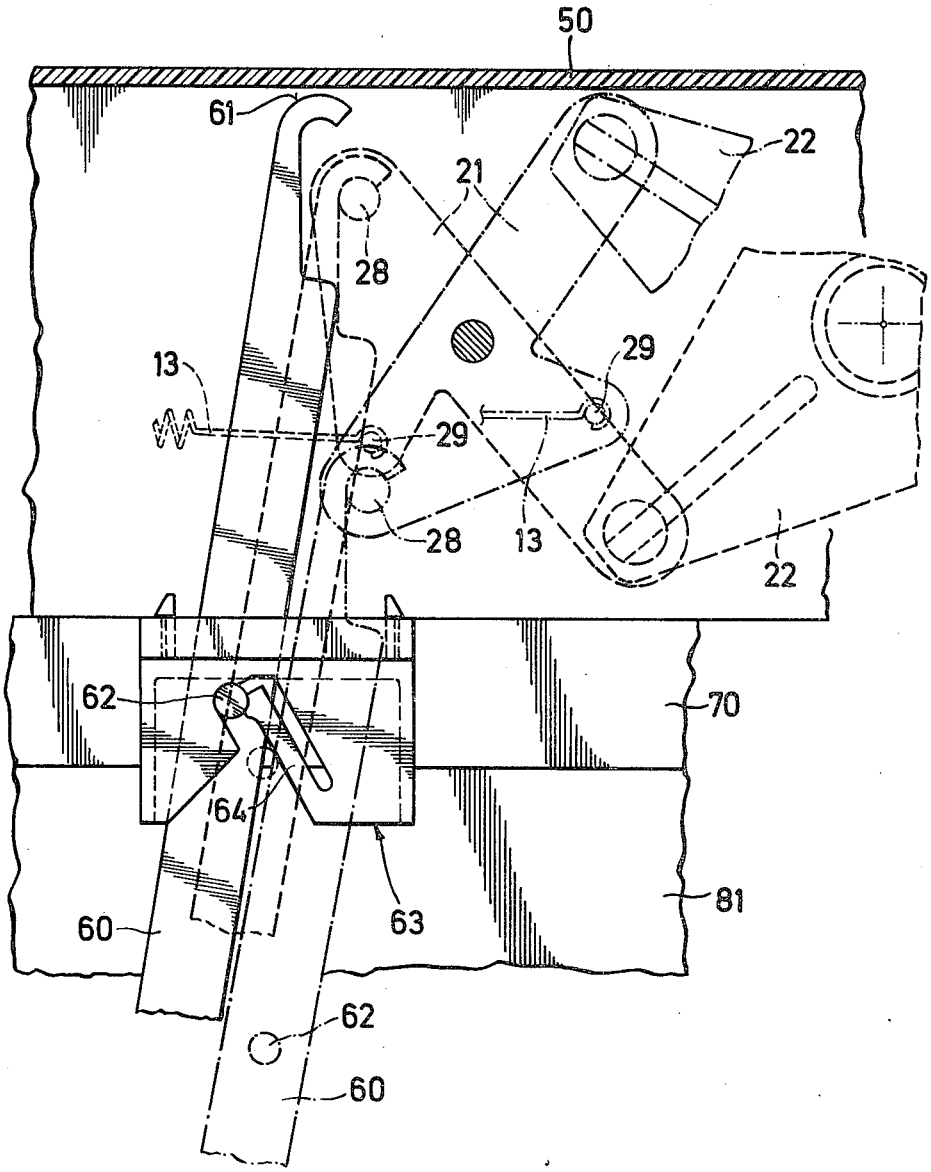
FIG. 6 is a side elevation of the pull rod of the container illustrated in FIG. 1, in various positions.

Before the lid frame is lifted off the capping strip 70, the connection between the pull rod 60 and the lever 21 mounted in the lid frame 50 must be released, this being shown in detail in FIG. 6. For this purpose a cam plate 63 with a resilient pawl 64 is attached to the capping strip 70 to guide the pull rod 60 via a pin 62 attached to the rod. To release the pull rod 60 from the lever 21, the pedal is lifted upwards with the instep of the foot, the container being closed, so that the pull rod 60 is moved, guided by the front of the resilient pawl 64 of the cam plate 63, out of the position shown in chain lines in FIG. 6 into the position shown in continuous lines, the hook-shaped end portion 61 disengaging from the pin 28. In the released position, shown in solid lines, the pull rod 60 is locked by the return force of the resilient pawl 64 which is also shaped at the top to grip the pin 62. Thereafter the lid frame 50 can be pivoted around the hinge 55*a*, 55*b*, 73*a*, 73*b* in the manner described hereinbefore for the emptying of the container. After the emptying of the container the lid frame 50 is again attached to the frame strip 70 and the pull rod 60 is again connected to the lever 21 by depressing the pedal 30 against the locking force of the pawl 64, the pin 62 snapping out of the grip of the pawl. If servicing personnel forget to raise the pedal 30 to release the pull rod 60 when the lid frame is unlocked, the lid frame 50 cannot be released, since if the lid frame 50 were to be raised without the pull rod 60 being previously released, the lid 12 would be opened, for which, with the lever relationships, a considerable force would be necessary, to overcome the spring force of the tension spring 13. Servicing personnel therefore immediately notice the omission, namely not having previously released the pull rod, without any damage having been done to the container. No mistake can therefore be made in servicing the container—i.e., in lifting the lid frame 50. Moreover, it is extremely easy to release the pull rod 60 and raise the lid frame 50, so that specially trained servicing personnel are not required. To make things clearer, in FIG. 6 the position of the pull rod 60 and part of the lever mechanism 20 with the lid 12 opened is shown in chain dot lines.

FIGS. *7a* and *7b* show the frame strip 70 with an advantageous device for the suspension of the plastics or paper waste bag 75 in the container. The device comprises a stationary, rail member 76 having a hook-shape when viewed from the side which is attached to the rear side of the capping strip 70, and an opposed bent rail member 77, which is pivotably mounted on lateral parts of the capping strip 70. When a fresh bag 75 is suspended, the pivoted rail member 77 is tilted into the top position illustrated in FIG. *7a*. In the top position the pivoted rail member 77 engages with stop members 78*a* which prevent rearward pivoting beyond this position. In addition, below the pivoted rail member 77 further resilient stop members 78*b* are provided to prevent it from dropping back forwards. The front bag edge is pulled over the pivoted rail member 77, for instance, about 3 to 5 cm of the bag edge, then the rear bag edge is pulled over the rail member 76. Finally, the pivoted rail member 77 is tilted forwards and downwards over the resilient stop members 78*b* into the position illustrated in FIG. *7b*, the bag opening being pulled apart and stretched. During this tilting movement the pivoted rail member 77 is pivoted some distance beyond the "over-centre" point, at which the pivoted rail 77 occupies its foremost position and the bag opening is pulled furthest apart, whereafter the pivot rail member 77 abuts an abutment 78*c* provided along the front of the capping strip 70.

Figure 8A:
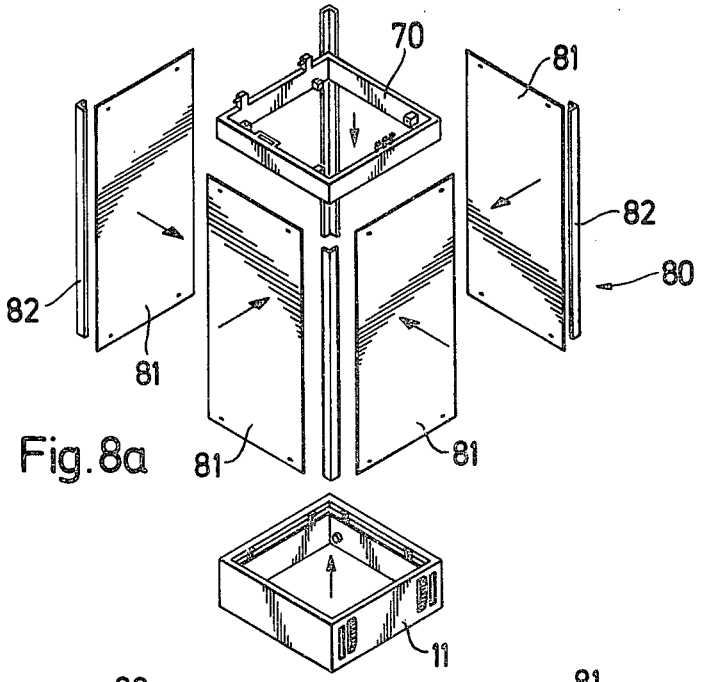
FIG. 8*a* is an exploded view of an embodiment of the container casing with the frame strip and the base of the container illustrated in FIG. 1.
Figure 8B:
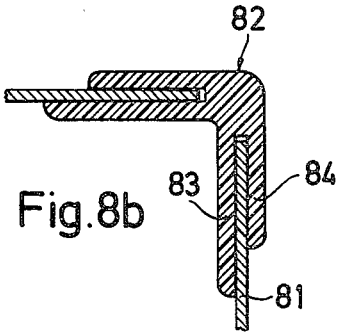
FIG. 8*b* is a cross-section through the corner connection between two wall parts of the container casing illustrated in FIG. 8*a*.
Figure 8C:
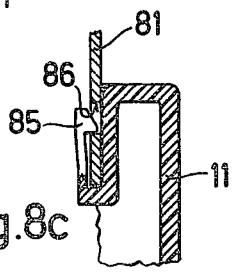
FIG. 8*c* is a longitudinal section through the connection between a wall part of the container casing illustrated in FIG. 8*a* and the base.

FIG. 8 shows a demountable and therefore economically transportable container casing 80, having four, for instance, sheet metal wall parts 81 interconnected by means of angle sections 82. The angle sections 82 have, for instance, as illustrated in FIG. *8b*, inner arms 83 and outer arms 84 of different lengths, between which the wall parts 81 are inserted. The container casing 80 made up of the wall parts 81 and angle sections 82 is inserted at the top into the matching capping strip 70 which, for instance, has a downwardly open "U" cross-section. The bottom of the container casing 80 is inserted in the matching base 11. As shown in FIG. *8c* which relates to the base 11, the capping strip 70 and base 11 have pawls 85 which latch into corresponding apertures 86 in the wall parts 81 to connect the casing 80 reliably and readily releasably to the capping strip 70 and base 11.

Figure 9:
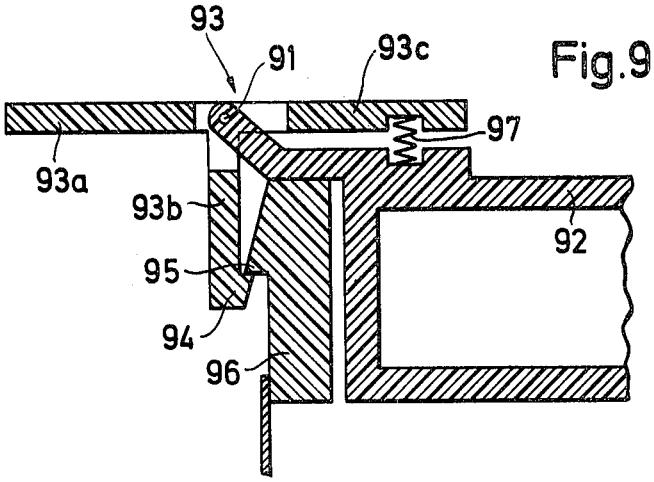
FIG. 9 is a longitudinal section through a system, disposed on the front side of a container according to the invention, for actuating and locking the lid.

FIG. 9 shows a variant system, namely a pawl mechanism for actuating and locking the lid of the container, in this arrangement shown at 92. A three-armed lever 93 is mounted on the lid 92 to pivot around an axis 91. A first arm 93*a* of a lever 93 is constructed as a handle. A second arm 93*b*, disposed at 90° in relation to the first arm, has a pawl 94 which can be brought into engagement with the projection 95 on the lid frame 96 and in the locked position locks the lid 92. Disposed between the top side of the lid 92 and the third lever arm 93*c* is a compression spring 97 which prestresses the locking between the pawl 94 and the projection 95.

Figure 10A:
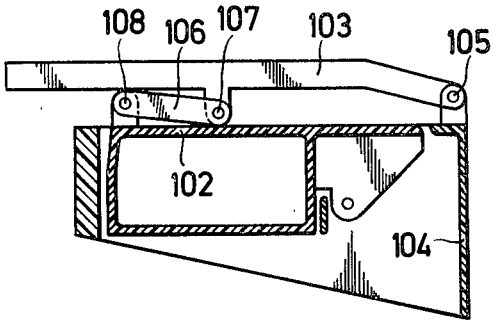
FIGS. 10*a* and 10*b* are longitudinal sections through the upper part of a container according to the invention in the closed and opened positions, with toggle lever mechanism for actuating and locking the lid.
Figure 10B:
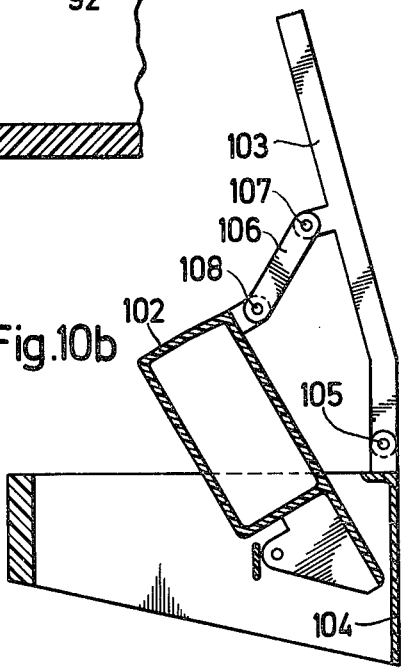
Figure 11A:
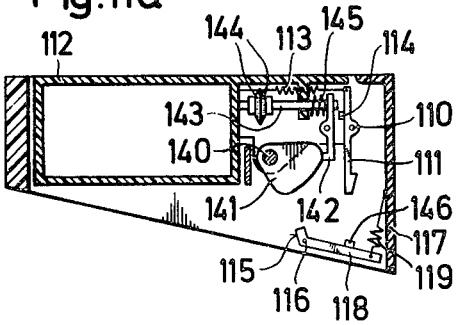
FIGS. 11*a* and 11*b* are longitudinal sections through the upper part of the container according to the invention in the closed and open conditions, with a pawl mechanism for locking the lid in the opened condition, and a system for automatically releasing the pawl mechanism.
Figure 11B:
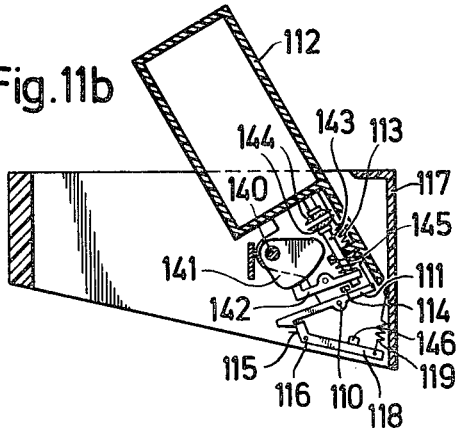

FIGS. 10*a* and 10*b* show a toggle lever mechanism for opening and closing a lid indicated at 102. A lever 103 is mounted on a lid frame 104 to pivot around an axis 105. Mounted between the lever 103 and the lid 102 is a toggle link 106 with pivot axes 107 and 108. When the lid 102 is closed the axis 107 is somewhat below the straight line connecting the axes 108 and 105. As a result the lid 102 is locked, without considerable force having to be exerted on the lever 103 to open the lid again. FIGS. 11*a* and 11*b* show a pawl mechanism for retaining a lid 112 in the opened condition and a system for automatically releasing the pawl mechanism after a brief delay. A pawl 111 mounted to pivot around an axis 110 on the lid 112 is pressed by a tension spring 113 against a stop 114. When the lid 112 is opened, the pawl 111 snaps on to a catch 115 and keeps the lid 112 open. The catch 115 is disposed at the end of the lever 118 being connected via a tension spring 119 to the lid frame 117, the tension spring 119 pressing the lever 118 against a stop 146. If the lid 112 is accidentally closed in this opened position, the catch 115 turns the lever 118 until the catch 115 disengages from the pawl 111 and releases the lid 112. A cam disc 141 fixed to the lid pivot 140 acts on a lever 142 and rod 143 to push two suction cups together when the lid 112 is closed. Air is supplied to the suction cups via a small hole. When the lid 112 is opened, the suction cups 144 are slowly released by the force of a compression spring 145, as shown in FIG. 11*b*. When the rod 143 contacts the pawl 111, the latter is moved to disengage the catch 115 and releases the lid 112, the contact pressure on the waste being produced in this embodiment by the kinetic energy of the freely pivoting lid.

Figure 12B:
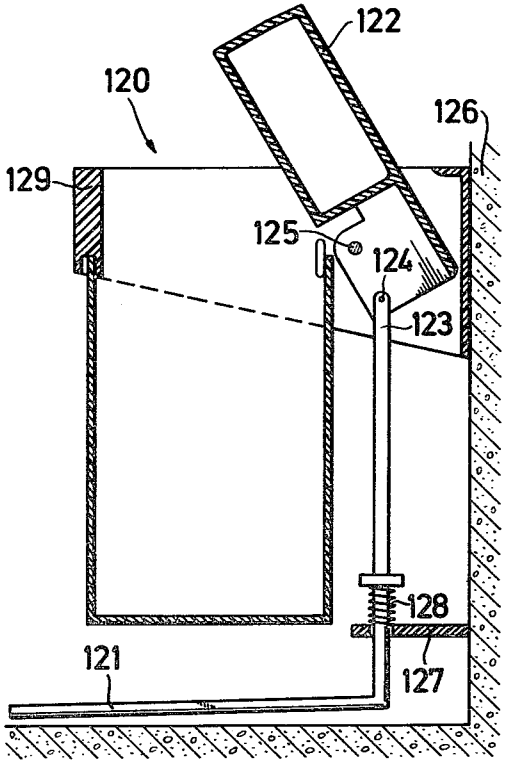
FIGS. 12*a* and 12*b* are longitudinal sections through a container according to the invention in the closed and open conditions, with a pedal-operated system for adjusting and locking the lid.
Figure 12A:
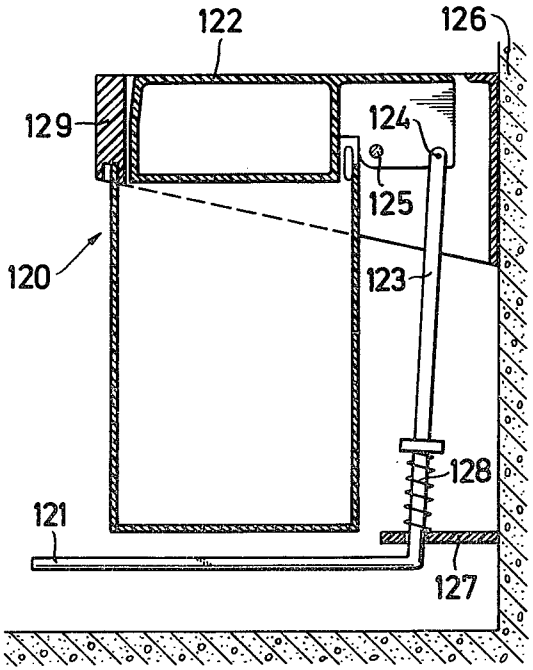

FIGS. 12*a* and 12*b* show a container 120 with an L-shaped pedal member 121 for operating and locking a lid 122. The vertical arm 123 of pedal member 121 is mounted on the lid 122 at a place 124 eccentric of the pivot 125 of the lid 122. By a suitable selection of the place 124 in relation to the pivot 125 of the contact pressure during the closure movement and in the closed position of the lid can be defined as required. A guide bracket 127 for the arm 123 is attached to a wall 126. Disposed between the bracket 127 and the arm 123 is a compression spring 128 which forces the arm 123 upwards. As a result on the one hand the lid 122 is forced downwards into the lid frame 129, and on the other the pedal member 121 is lifted from the ground. If the operator applies his foot to the pedal member 121, the arm 123 moves downwards and opens the lid 122. When the pedal member 121 is released, the lid 122 is closed again and locked by the spring 128, so that the operative lever arm of the spring 128 in relation to the pivot 125, and therefore, the contact pressure of the lid 112 during the lid closure movement increases.

What is claimed is:

1. A container for waste material such as paper or the like, comprising, a casing forming a stationary container for waste material and including a top structure defining an opening for entry into the container, a lid pivotally mounted at one end on the casing adjacent the opening for movement between an open position allowing waste to be put into the stationary container through the top structure, and a closed position closing the opening of the container, the lid being integrally formed with a downwardly projecting portion that, in the closed position, extends into the stationary container beyond the upper extremity of said top structure to compressively occupy a volume within the container at least equal to that of an item of waste for which the container is intended, and means for releasably retaining the lid in its closed position.

2. A container according to claim 1, wherein the lid is mounted to pivot about a horizontal axis, and comprising means for causing an increasing contact pressure of the lid on waste in the container when the lid moves from the open to the closed position.

3. A container according to claim 2, wherein the means for causing an increasing contact pressure comprises a lever mechanism which at the end of its travel locks the lid in the closed position.

4. A container according to claim 3, wherein the lever mechanism comprises a cam member controlled by a lever.

5. A container according to claim 3, wherein the lever mechanism comprises a first lever pivotably mounted on said top structure and having a drive dog mounted thereon, and a second lever attached for rotation with the lid and having a slot for receiving and guiding the drive dog, the two levers forming substantially a right angle with one another when the lid is in its closed position.

6. A container according to claim 5, wherein the first lever has two arms, the drive dog being mounted on one arm and a pull rod and a tension spring are provided connected to the other arm, the tension spring being attached at its other end to said top structure.

7. A container according to claim 6, wherein a pedal is provided connected to the pull rod, the pedal being mounted in the base of the container.

8. A container according to claim 7, wherein the pedal comprises a treadle and two pedal arms which are mounted in the base of the container to pivot around a horizontal axis and a rack and pinion mechanism arranged to synchronise the movement of the pedal arms.

9. A container according to claim 3, wherein the lever mechanism comprises a lever controlled by a cam member.

10. A container according to claim 3, wherein the lever mechanism comprises a toggle mechanism.

11. A container according to claim 3, wherein the lever mechanism comprises a spring operating via a lever arm which increases in size during the closure movement of the lid.

12. A container according to claim 11, wherein the lever mechanism comprises an L-shaped pedal member having the vertical arm which is connected to the lid eccentrically of its pivot axis and holds the lid closed, under the action of said spring.

13. A container according to claim 2, wherein the lid is provided with means for manually actuating it and a releasable locking device to lock it in its closed position, and the device for increasing the contact pressure acts on the manual actuating means.

14. A container according to claim 13, wherein the lid is provided with a three-armed actuating lever which is mounted on the lid, the first arm having the form of a handle, the second arm lying at an angle of 90° in relation to the first arm, having a pawl which in the closed position of the lid latches to behind a projection provided on said top structure to lock the lid, and the third arm being disposed in a rectilinear continuation of the first arm and being connected via a compression spring to the top of the lid.

15. A container according to claim 2, wherein the lid is manually operated and a releasable device is provided by means of which the lid can be locked in its opened position and locked in its closed position, the releasable device having means for automatically releasing the lid from its open position, and the device causing an increasing contact pressure in the lid itself which falls freely after the lid has been so automatically released.

16. A container according to claim 1 including a maintenance signalling device, having a spring loaded pressure sensor which is disposed in the lid and connected to an indicating device visible from outside the container.

17. A container according to claim 1 wherein the lid is mounted to pivot around a horizontal axis in said top structure and said top structure is in the form of a lid frame which has substantially the same height as the lid and is releasably connected to the container casing.

18. A container according to claim 17, wherein the lid frame has at its rear edge at least one rearwardly opened hinge seat, each such hinge seat being latched on to a hinge pin rigidly connected to the container casing, and wherein the lid frame is connected at its front edge via a releasable pawl mechanism to the container casing.

19. A container according to claim 18, wherein a locking device is provided which prevents the released lid frame from moving forwards.

20. A container according to claim 17, including a pedal operated pull rod arranged to lift the lid on depression of the pedal by means of a lever mechanism, mounted in said lid frame, wherein the pull rod is releasably connected to the lever mechanism.

21. A container according to claim 20, comprising a cam plate which is attached to the container casing and arranged to guide the pull rod so that when the pedal is slightly lifted the pull rod is released from the lever mechanism mounted in the lid frame, the cam plate being provided with means for resiliently retaining the pull rod in its position when so released from the lever mechanism.

22. A container according to claim 18 including a capping strip at the top of the container casing which is releasably connected to the casing and to which said hinge pins and parts of the releasable pawl mechanism for mounting the lid frame of the casing, are attached.

23. A container according to claim 22 wherein the container casing is rectangular in cross-section and comprises four wall parts which are releasably connected by means of angle sections and are releasably connected by means of pawl mechanisms at the top to the capping strip and at the bottom to a base.

24. A container according to claim 1 comprising a stationary, hook-shaped rail member and an opposed, pivotably mounted rail member disposed at the top end of the container casing for the suspension of a waste bag.

25. A container according to claim 1, wherein the container casing can be disassembled.

* * * * *